US007195101B2

(12) United States Patent
Ubinana Felix

(10) Patent No.: US 7,195,101 B2
(45) Date of Patent: Mar. 27, 2007

(54) FACADE SCAFFOLD

(75) Inventor: Jose Luis Ubinana Felix, Parets del Valles (ES)

(73) Assignee: Ingenieria de Encofrados y Servicios, S.L., Parets del Valles (ES)

( * ) Notice: Subject to any disclaimer, the term of this patent is extended or adjusted under 35 U.S.C. 154(b) by 0 days.

(21) Appl. No.: 11/143,171

(22) Filed: Jun. 1, 2005

(65) Prior Publication Data

US 2005/0205357 A1 Sep. 22, 2005

Related U.S. Application Data

(63) Continuation of application No. PCT/ES03/00613, filed on Dec. 1, 2003.

(30) Foreign Application Priority Data

Dec. 2, 2002 (ES) ..... 200202762

(51) Int. Cl.
*E04G 7/00* (2006.01)

(52) U.S. Cl. ..... 182/178.1; 182/186.8; 403/49

(58) Field of Classification Search ..... 182/178.1, 182/179.1, 82, 186.7, 186.8; 403/49
See application file for complete search history.

(56) References Cited

U.S. PATENT DOCUMENTS

| | | | | |
|---|---|---|---|---|
| 895,578 | A * | 8/1908 | McNamara | 160/82 |
| 2,681,834 | A * | 6/1954 | Benson et al. | 52/645 |
| 2,701,167 | A * | 2/1955 | Kirkpatrick | 52/645 |
| 3,656,580 | A | 4/1972 | Gostling | |
| 4,095,910 | A * | 6/1978 | Steele et al. | 403/49 |
| 4,599,010 | A * | 7/1986 | Hocking | 403/191 |
| 4,630,956 | A * | 12/1986 | Gilbreath | 403/49 |
| 6,062,341 | A * | 5/2000 | Frank et al. | 182/113 |
| 6,322,277 | B1 * | 11/2001 | Jennings | 403/49 |
| 6,450,291 | B1 * | 9/2002 | Ono | 182/178.1 |
| 6,688,430 | B1 * | 2/2004 | Wallther | 182/186.8 |
| 6,732,836 | B2 * | 5/2004 | Ono | 182/113 |
| 2004/0211624 | A1 * | 10/2004 | Wallther | 182/186.7 |

FOREIGN PATENT DOCUMENTS

| | | |
|---|---|---|
| DE | 1 559 069 | 9/1969 |
| FR | 1 561 476 | 3/1969 |
| FR | 2 478 712 | 9/1981 |
| GB | 1 204 328 | 9/1970 |
| JP | 8-284439 | 10/1996 |

* cited by examiner

*Primary Examiner*—Alvin Chin-Shue
(74) *Attorney, Agent, or Firm*—Darby & Darby

(57) ABSTRACT

The scaffold has demountable elements which can be connected to one another to make up lateral frames that incorporate vertical members, flooring platforms or planks, diagonal bracing bars, and handrail poles, and is characterized in that the said lateral frames are composed of an inverted L-shaped element and a straight pole which is connected, by a quick coupling without clearance, to the horizontal arm of the L, and is optionally complemented by further poles to make up the lateral frames, both the straight pole and the vertical or longer arm of the inverted L-shaped element being provided with quick couplings with swinging clamping pieces which are intended to receive the flattened ends of reinforcing tie rods and safety-rail poles.

14 Claims, 9 Drawing Sheets

FACADE SCAFFOLD

CROSS REFERENCE TO PRIOR APPLICATION

This application is a continuation of International Patent Application Serial No. PCT/ES2003/000613, filed Dec. 1, 2003, which claims priority of Spanish Application No. 200202762, filed Dec. 2, 2002, both of which are incorporated by reference herein. PCT/ES2003/000613 published in Spanish on Jun. 17, 2004 as WO 2004/051030 A1.

TECHNICAL FIELD

The present invention is intended to disclose a novel facade scaffold which has appreciable characteristics of novelty and inventiveness.

BACKGROUND

Currently, there are various known systems for the construction of facade scaffolds, which systems are based on lateral frames that incorporate vertical members, flooring platforms or planks, diagonal bracing bars, and handrail poles. Scaffold frames of various geometrical constructions are known, the main ones being the following:

- one-piece rectangular frames with two pin couplings with clearance, which constitute articulation points,
- portico-type Π frames with two pin couplings with clearance which constitute articulation points,
- one-piece H-shaped frames with two pin couplings with clearance which constitute articulation points,
- one-piece frames with asymmetric sides with two pin couplings with clearance which constitute articulation points (FR 2 516 141),
- two-piece frames with asymmetric sides with three pin couplings with clearance, which constitute articulation points (U.S. Pat. No. 6,422,345),
- two-and three piece frames with asymmetric sides with two pin couplings with clearance, which constitute articulation points, one of the pieces being L-shaped (FR 1561476).

These constructions are particularly susceptible to damage in transportation, require considerable storage space, and are quite difficult to fit together, owing to the need for the operator simultaneously to insert the two ends of the vertical members of each element in the corresponding housings of the already erected elements.

The scaffold of the present invention is intended to solve the above-mentioned problems, achieving quicker and safer erection than that which is currently known, with regard both to the elements making up the assemblies perpendicular to the facade and to the erection of the rails of the various modules from the corresponding lower module. Similarly, the space required for the storage and transportation of the parts of the scaffold is considerably reduced and a rigidity equivalent to that of a single-piece frame is maintained by reducing to the minimum the number of couplings with clearance between structural elements. At the same time, improved endurance in transportation is achieved by preventing damage between the parts which make up the scaffold.

SUMMARY

Basically, the scaffold of the present invention is characterized in that it comprises a repetitive, modular unit with two pieces, an L-shaped piece with unequal arms and another piece which is constituted by a simple straight pole, making up a very rigid frame once the modular pieces have been assembled; the above-mentioned pieces can be connected before or after their installation in the scaffold and are combined with a quick-coupling device without clearance for connecting the straight piece to the horizontal arm of the other piece so that, during the erection of the assembly perpendicular to the facade of the building, the successive incorporation of the various elements will produce a very rigid structure. Another characteristic of the scaffold of the present invention is that the handrail poles can be installed and dismantled very easily from the immediately lower level of the scaffold. For this purpose, the ends of the said poles have holes of a special shape. These holes fit the cross-section of a coupler fixed to the vertical members of the scaffold frames. The handrail pole can be fitted rapidly and with a single movement at any angle, by virtue of an automatically-activated, retractable retaining clamping piece, and can be removed by operating the said clamping piece manually or by pivoting the bars to an angle at which the clamping piece coincides with slots of the end hole of the pole. This removal by pivoting is what enables the handrails to be disassembled from the immediately lower level.

The scaffold of the present invention provides, in two-piece frames with a quick coupling system, by means of rigid couplings, a split frame which, once assembled, is structurally equivalent to one-piece frames, and in which:

- the pieces which form the frame can be connected before or after their installation in the scaffold,
- the space required for storage is greatly reduced in comparison with conventional rectangular frames,
- the elements are easier to transport and much stronger with regard to deformation and skewing than H-shaped frames,
- the final handrail poles can be installed from the lower level, increasing the intrinsic safety of the system and eliminating the additional work resulting from the use of accessories such as climbing rails,
- the lightest element is that which has to be lifted most in order to fit it in its housing (the mounting pin of the lower module); the lightness of this element, which is a simple 2 m tube with its fastening elements, results in greater convenience of use and greater safety,
- each element is fitted separately on a single pin, avoiding fitting at two points simultaneously which would require greater care by the assembler and also larger clearances,
- the frame combines the virtues of a single-piece frame and those of frames which are split into two pieces (structural rigidity and reduced space during storage and transportation) whilst overcoming disadvantages of other frames (it avoids the simultaneous fitting of two coupling pins).

The quick coupling system without clearance for coupling the horizontal element of the L-shaped piece with the vertical element affords many advantages:

- it couples the perpendicular tubes rigidly, preventing any relative rotation or displacement,
- the relative positions of the two tubes are not affected by the degree of tightening,
- quick installation and dismantling without the need for special tools; the coupling can be fastened by exerting pressure by hand or with a simple hammer blow,
- elimination of clearances and tightening by a circular, lever-type wedge of unchanging and irreversible gradient,
- simply locating the transverse tube in its housing, even without tightening the wedge, suffices to prevent accidental disassembly of the coupling, a series of ramps and conical inlets facilitate the insertion of the elements to be connected and come into alignment once the wedge is tightened.

With regard to the safety rails which are provided in the present invention, it is pointed out that:

they can be installed from the lower level, by virtue of the automatic coupling devices such as those described in the applicant's Spanish patent application No. 200100327 similarly, they can be dismantled from the lower level by virtue of the special profile of the holes in the ends of the handrail poles, poles, or the demountable upright member itself, can be used for their installation and dismantling from the lower level, the scaffold is also arranged for the use of climbing safety rails on one or both sides, incorporating the rings of the applicant's Spanish patent application No. 200100327.

BRIEF DESCRIPTION OF THE DRAWING FIGURES

For a better understanding, some drawings of a preferred embodiment of the present invention are appended by way of non-limiting example.

DETAILED DESCRIPTION OF PREFERRED EMBODIMENTS

Figure 1A:
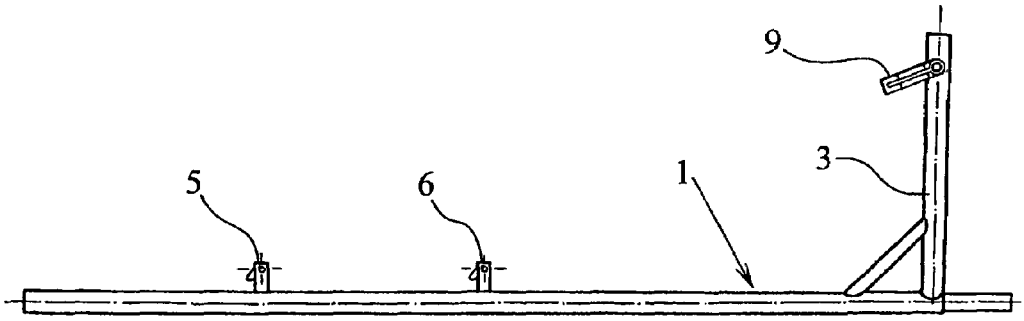
FIG. 1A is a view of an L-shaped element for making up the transverse scaffold assemblies, which carries, on its transverse element, a portion of a quick coupling without clearance which is characteristic of the present invention.

As can be seen from the drawings, the scaffold of the present invention is constructed on the basis of a right-angled or L-shaped element 1, the component arms of which are indicated 2 and 3, and a straight pole 4, which are coupled with one another by means of a special quick coupling without play, making up a modular element; the repetition of this modular element, together with optional additional poles, not shown, will permit the construction of an assembly perpendicular to the facade in a demountable facade scaffold.

The element 1, as well as the pole 4, will be provided with a variable number of couplers with clamping pieces such as those indicated 5 and 6 for the element 1 and 7 and 8 for the pole 4. Moreover, the arm 3 of the L-shaped element 1 that is perpendicular to the arm 2 will have, at its end, a portion 9 of a quick coupling without play according to the present invention, whereas the pole 4 will have the other portion 10 of the said coupling, the construction of which can be seen in greater detail in FIGS. 2 and 6 to 12.

Figure 1B:
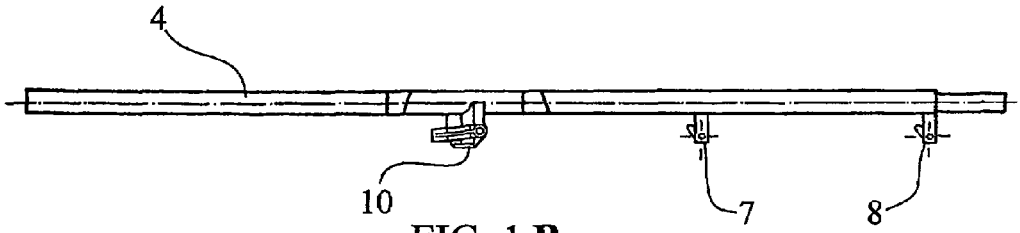
FIG. 1B shows a straight pole which is intended to be complemented by the L-shaped element of FIG. 1A in order to make up a modular element of a transverse scaffold assembly.
Figure 2:
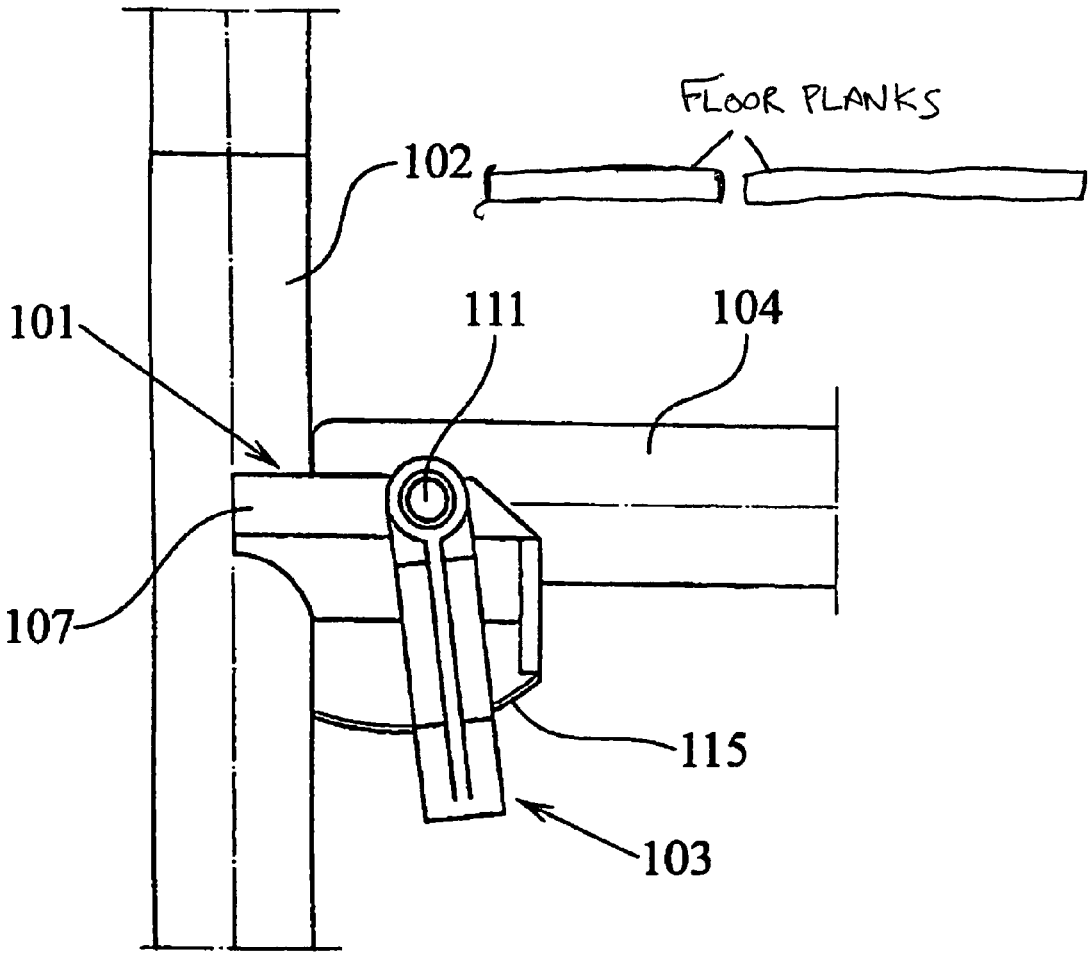
FIG. 2 shows a detail of the coupling of the L-shaped element and the pole shown in FIGS. 1A and 1B, respectively.
Figure 3:
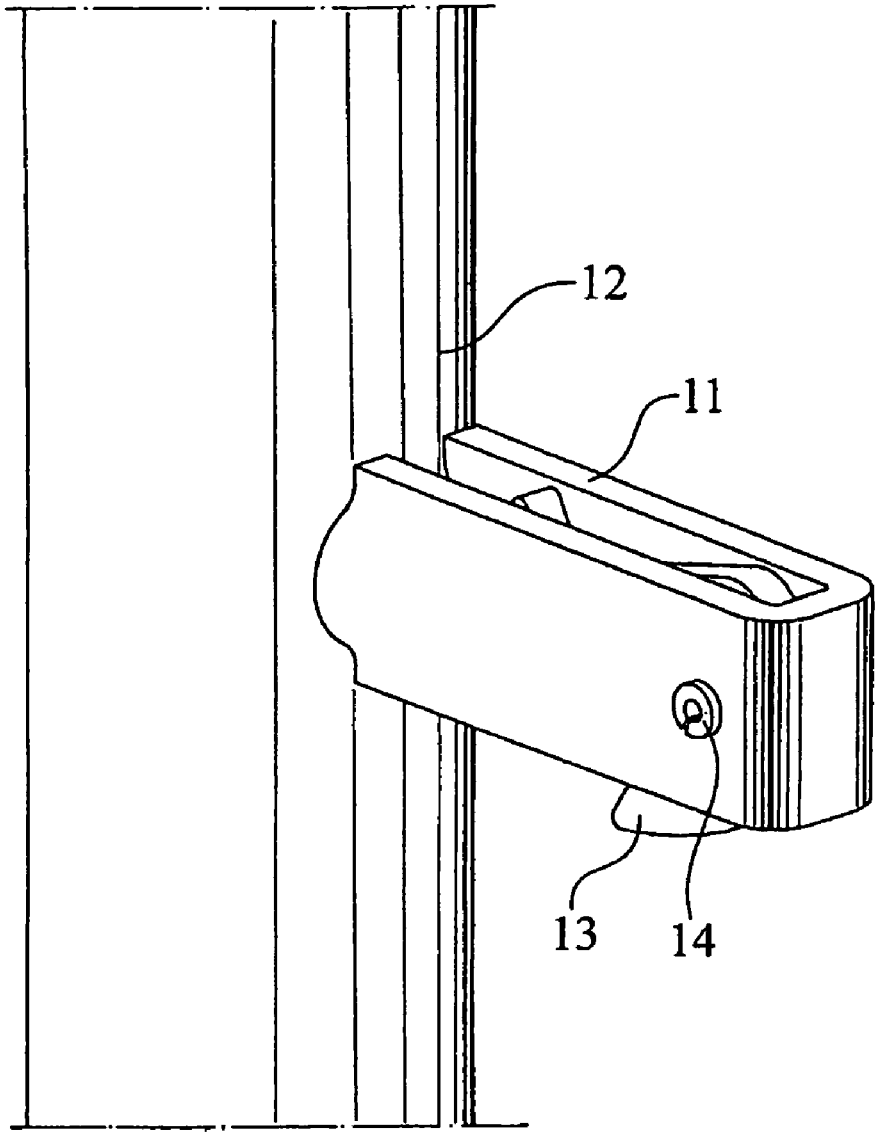
FIG. 3 is a perspective view of a coupler with clamping piece.

The couplings with retaining clamping pieces, which are indicated schematically 5, 6, 7 and 8 in FIGS. 1 and 1 bis can be seen in greater detail in FIG. 3, which shows one of the said couplings which is composed of an enveloping body 11, for example, of a very narrow U-shape, which is fixed to the corresponding pole, for example, the pole 12, and has an internal swinging clamping piece 13 which is pivotable about a pin 14. This coupling corresponds to that which is the subject of the applicant's current Spanish application No. 200100327 which permits the quick coupling of a flattened end of a reinforcing pole or a pole of another type, for example, making up a safety handrail, etc.

Figure 4:
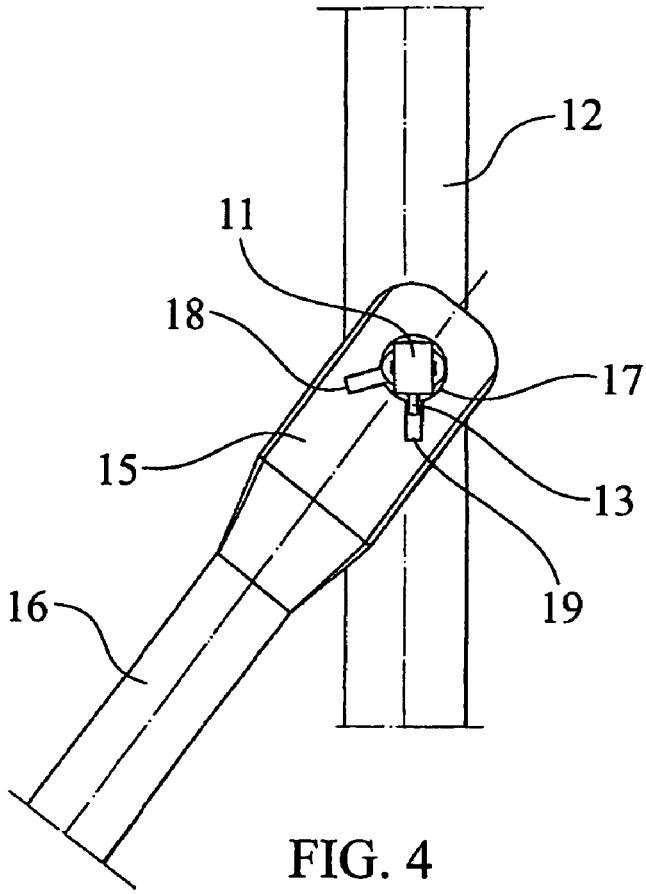
FIGS. 4 and 5 show respective positions of assembly and use of an element associated with a vertical pole carrying a coupling with a retaining clamping piece.
Figure 5:
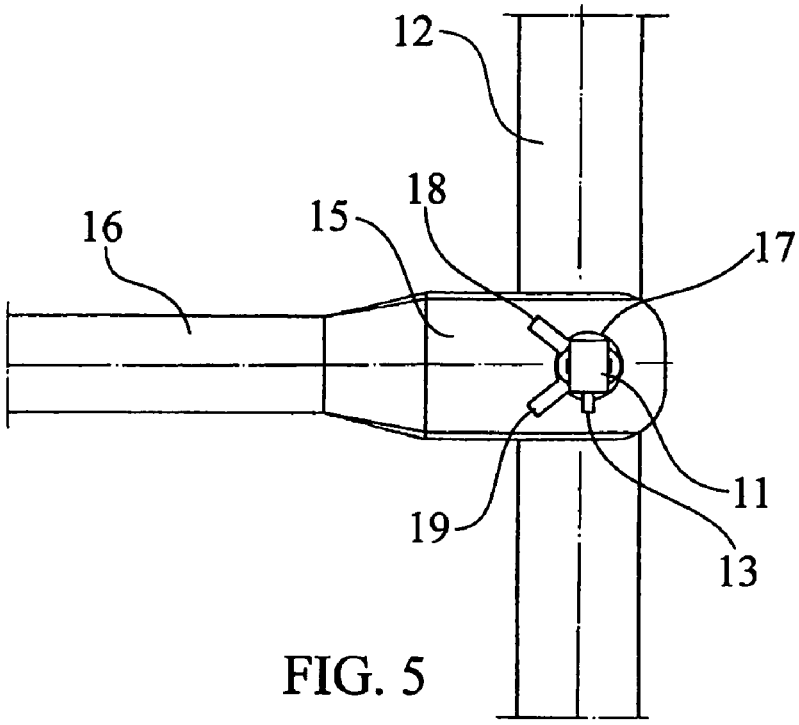
Figure 6:
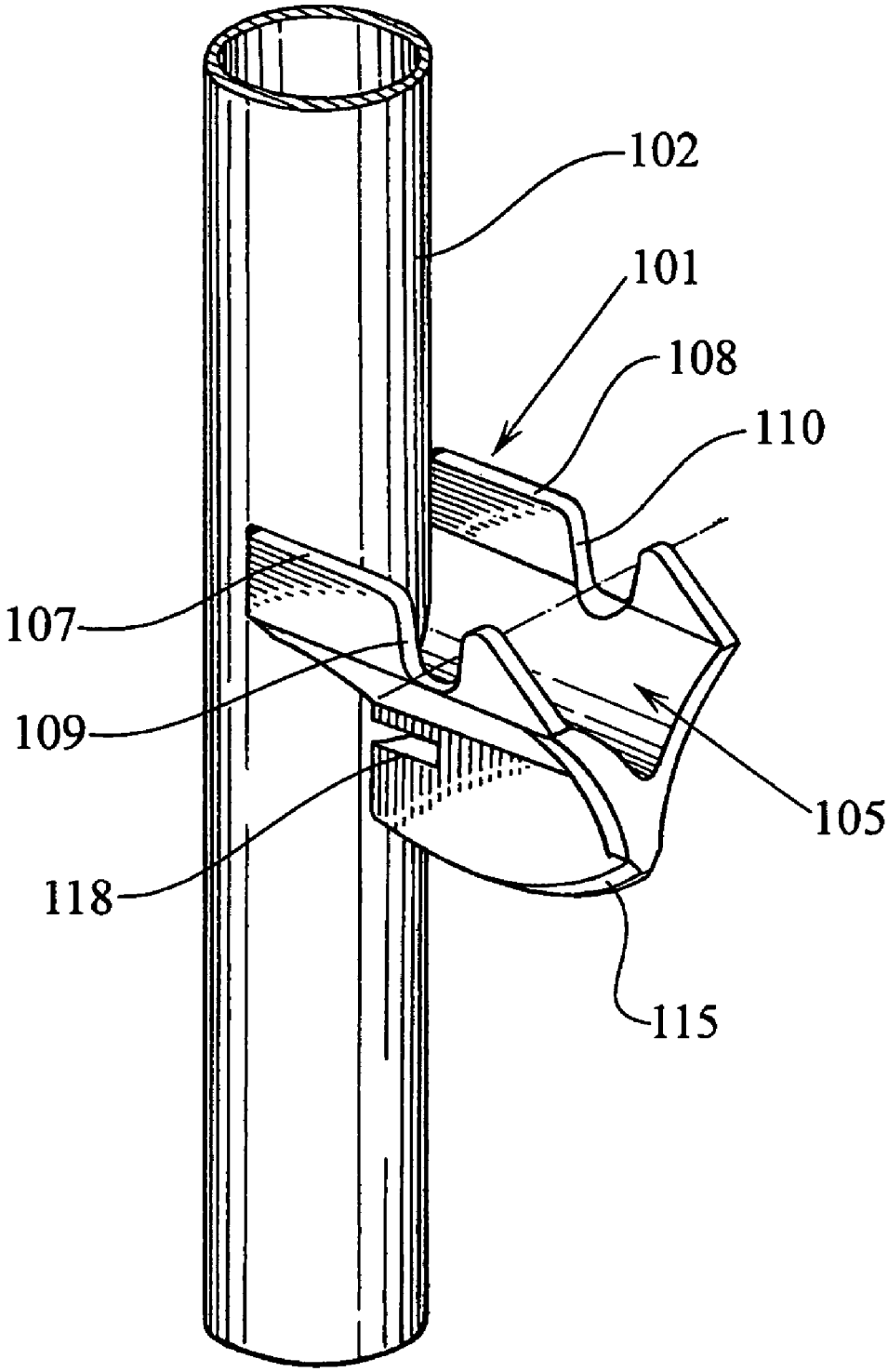
FIG. 6 is a perspective view of a vertical scaffold element which incorporates a piece for receiving the end of the crosspiece according to the present invention.
Figure 7:
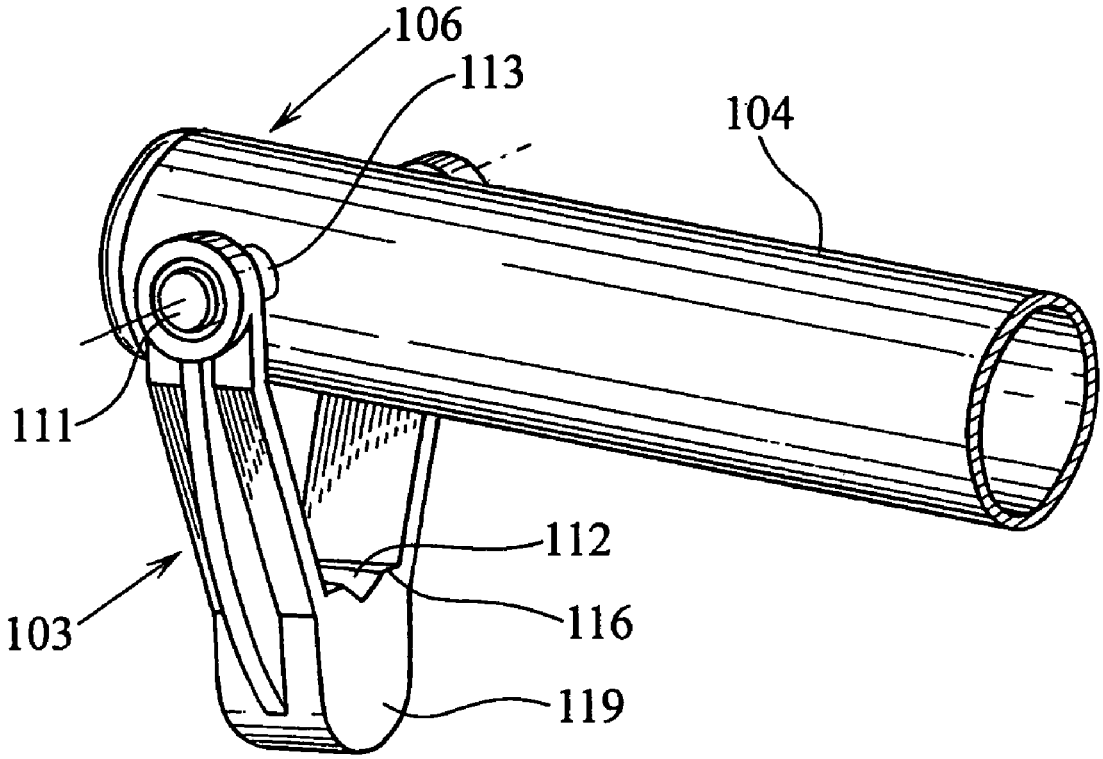
FIG. 7 is a perspective view of an end of a crosspiece or horizontal element of the invention.

To facilitate disassembly of the elements making up the safety rail of an upper level from a lower level, the present invention provides for the arrangement shown in FIGS. 4 and 5, in which it can be seen that the flattened end 15 of a rail element 16 has an opening 17 of variable shape, preferably of circular shape, which enables it to be fitted perpendicularly on the U-shaped body 11 of the coupling shown in FIG. 3; the end 15 of the rail element 16 also has inclined slots 18 and 19 the width of which allows the retaining clamping piece 13 of the coupling portion 11 to pass through. In the angular position shown in FIG. 4, the flattened end 15 of the pole 16 can thus easily be fitted by causing the clamping piece 13 to coincide with one of the inclined slots of the said flattened end whereas, after the said pole 16 has been pivoted angularly, it will be located in the position shown in FIG. 5 in which the clamping piece 13 effectively retains the end of the pole which will be in the firm position of use. When the time comes for disassembly, pivoting of the said pole by the operator from the lower level will suffice to cause the clamping piece of the coupling to coincide once more with the corresponding slot, enabling the said pole to be removed easily.

To disassemble a rail element, it is possible to proceed manually from the same platform by pushing the manual clamping pieces of both ends in manually in order to be able to separate the rail element, for example, for partial disassembly, if an opening is to be obtained at the front in order to introduce or remove elements through an opening, etc.

As shown in FIGS. 6 to 12, the present invention provides for a quick coupling without play for the connection of elements 102 and 104; the coupling is formed by a receiving piece 101 connected to one side of a vertical tubular scaffold element, indicated 102, and a swinging fastening piece 103 connected pivotably to a tubular element 104 of a horizontal scaffold element or crosspiece which is to be connected to the vertical element.

Figure 8:
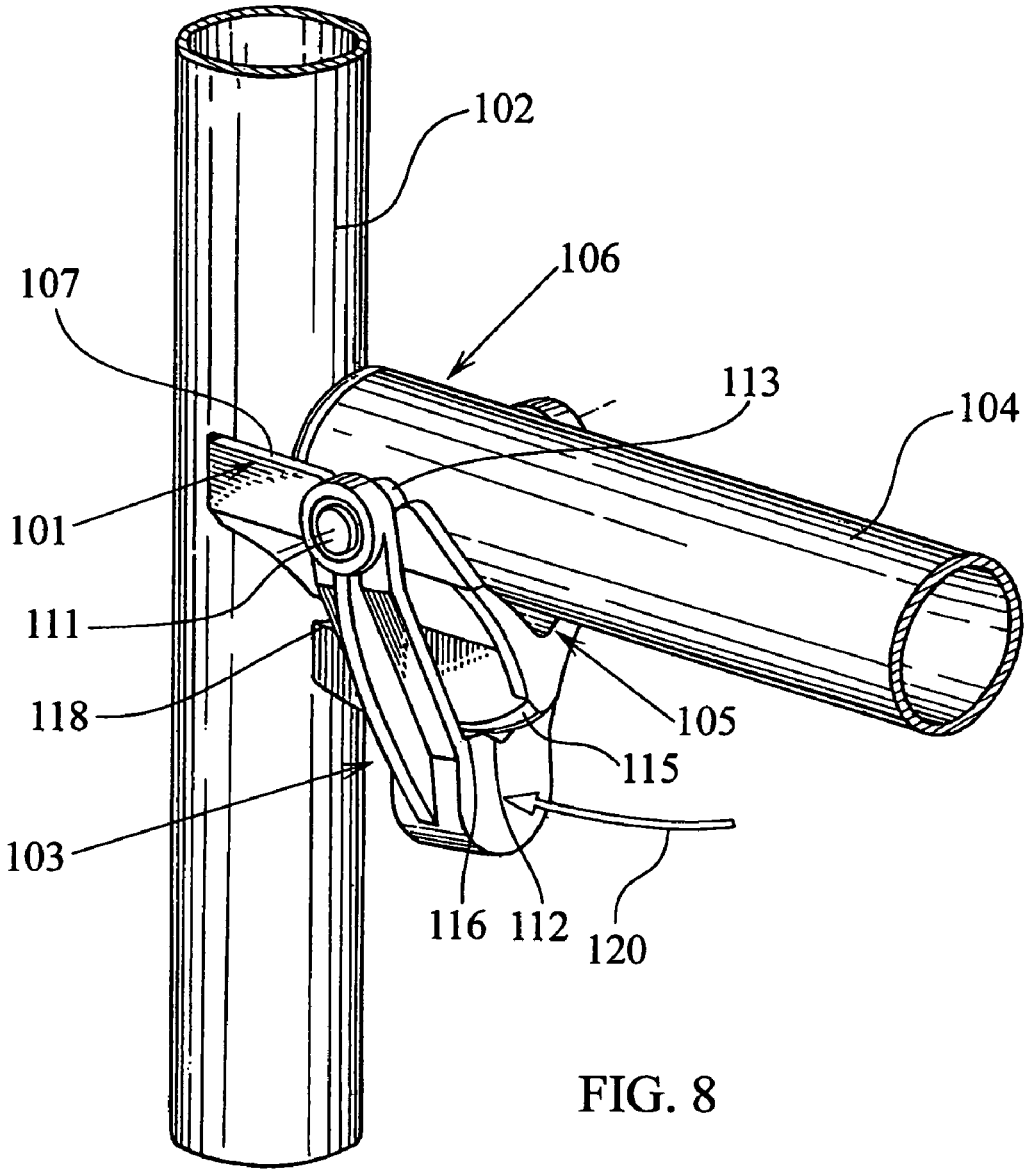
FIG. 8 is a perspective view which shows the coupling of a vertical element and a horizontal element with the device of the present invention.

The piece 101 has a housing 105 for receiving the end 106 of a crosspiece 104, as can be seen in FIG. 8, and has, in the flanges 107 and 108 which delimit the said housing 105 laterally, respective indentations 109 and 110 for receiving lateral projections which are intended to coincide with the indentations 109 and 110 for locating purposes. In a preferred version, the said projections may be constituted by intermediate regions of a transverse pin 111 on which the swinging piece 103 pivots. In this case, collars such as those indicated 113 and 114 in FIGS. 8 and 9 are distinguished; the collars coincide with the indentations 109 and 110, bringing about the location of the end of the crosspiece 104.

Figures 9, 10:
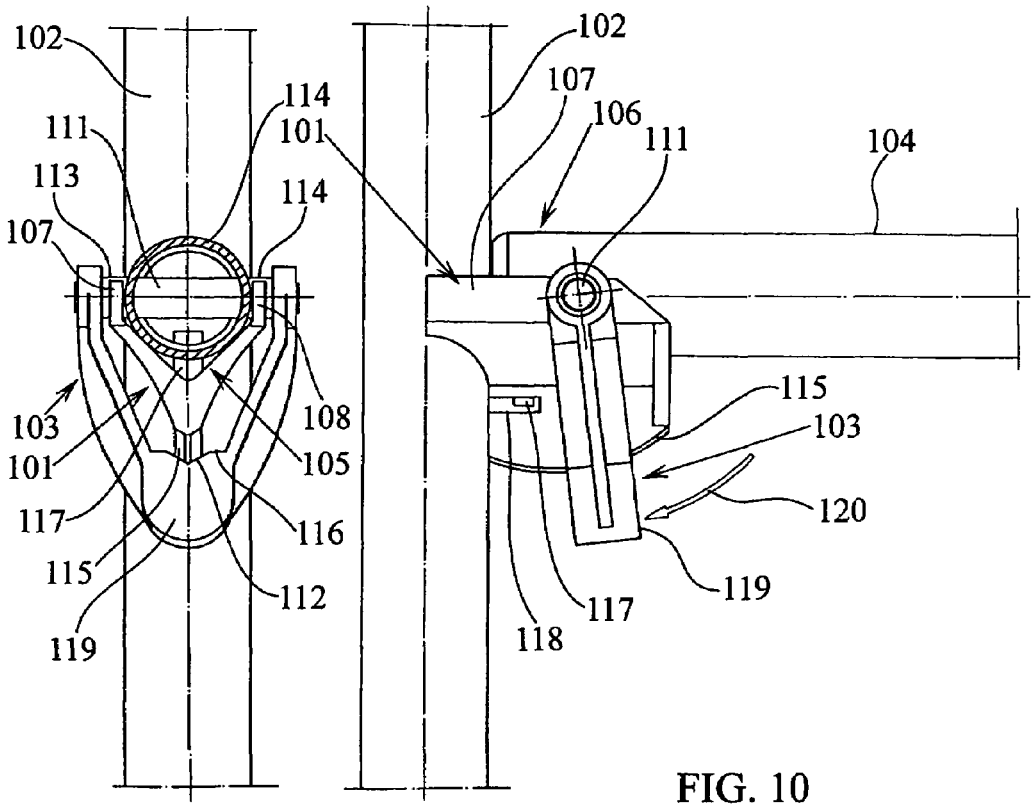
FIGS. 9 and 10 are front and side elevational views, respectively, of a device according to the present invention, showing the way in which a horizontal element and a vertical element of the scaffold are assembled.
Figures 11, 12:
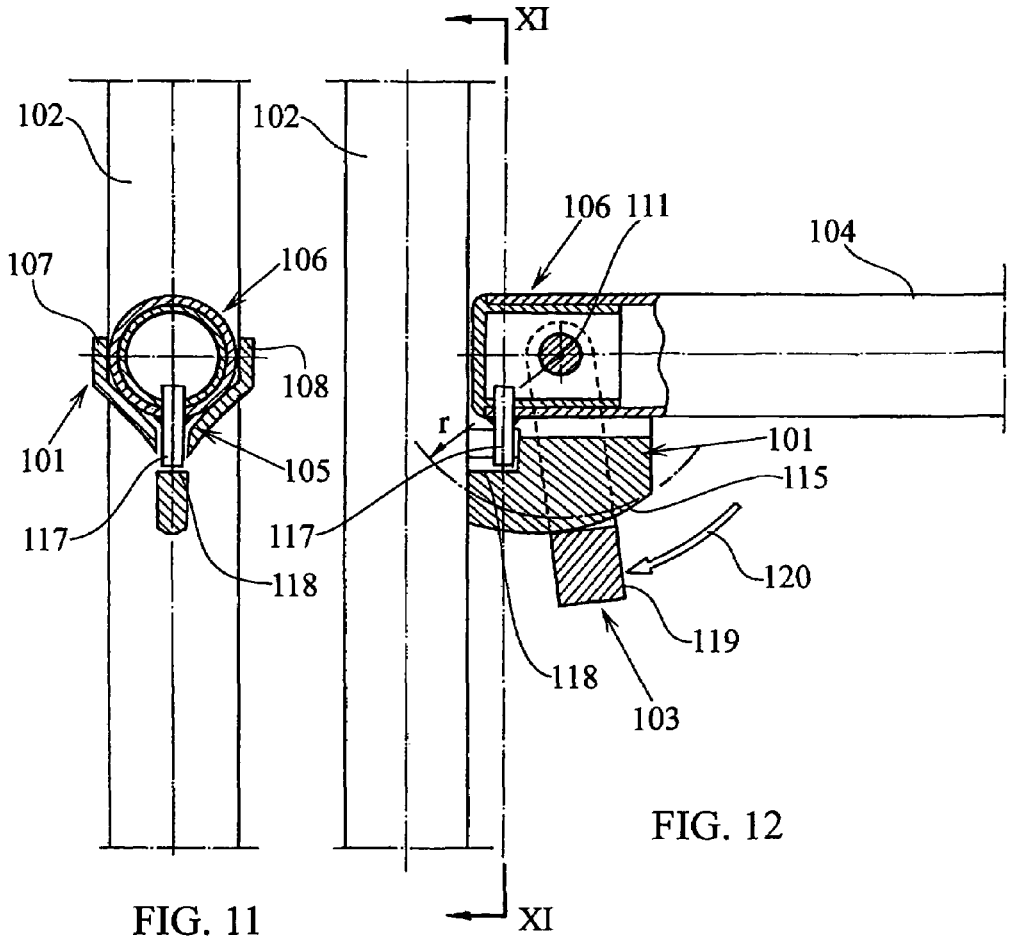
FIGS. 11 and 12 are views similar to FIGS. 9 and 10, in section.

The piece 101 has, at the bottom, a curved edge 115 for receiving the internal edge of the swinging piece 103 in a wedging action which is shown in FIGS. 8, 10 and 12.

The piece 103 adopts a generally V-shaped, U-shaped or similar structure, swinging on the end of the crosspiece 104 and having, at the bottom, a coupling edge or region 116 with a groove 112 which coincides with the arcuate edge 115 of the piece 101, performing the fastening by wedging.

As will be appreciated in FIGS. 8 to 10 in particular, the crosspiece or tubular element 104 has, in the vicinity of its end 106, a projection 117 which coincides with the interior of a recess 118 which the piece 101 has in the vicinity of its fastening to the tubular element 102.

By virtue of the arrangement of elements shown, it will be understood that the assembly of a crosspiece 104 with a vertical element 102 is very simple since it suffices to cause the end 106 of the crosspiece to fit over the receiving piece 101 in order for location to be brought about immediately by the indentations 109 and 110 and by the recess 118, after which the swinging piece 103, which may have an eccentric mass 119 for promoting its pivoting, can simply be struck as indicated by the arrow 120 in FIG. 8 in order to achieve firm coupling of the horizontal element with the vertical element of the scaffold.

Although the receiving piece 101 has been shown fixed firmly to the vertical element 102, for example, by welding, it will be understood that the said firm fixing could also be performed by means of transverse pins mounted so as to extend through the flanges of the piece 101 and the vertical element, or by any other device which achieves the function indicated. Similarly, the vertical coupling piece 103, the structure of which is described above as V-shaped, could have another structure, for example a U-shaped structure, etc. or may even purely be a swinging arm, that is, adopting an approximately L-shaped structure, or the like.

The invention claimed is:

1. A facade scaffold formed of demountable elements which can be connected to one another to form lateral frames that include vertical members, the lateral frames comprising:

an inverted L-shaped member that is defined by a vertical portion and a horizontal portion;

a first elongated support member;

flooring platforms; and one or more other elongated reinforcing members;

wherein the first elongated support member is connected on a side thereof by a first quick coupling mechanism, without clearance, to the horizontal portion of the L-shaped member and both the first elongated support member and the vertical portion of the L-shaped member include second quick coupling mechanisms with pivotable clamping pieces that are intended to receive complementary first ends of the elongated reinforcing members, wherein the first quick coupling mechanism between the L-shaped member and the first elongated support member which is in the form of a vertical pole of the scaffold comprises a receiving portion which is integral to and extends outwardly from one side of the vertical pole and includes a housing for receiving an end of the horizontal portion of the L-shaped member that includes a pivotable fastener which includes a locating feature for locating the horizontal portion in the receiving portion of the vertical pole and is configured so that it is fasteningly coupled to the receiving portion by a wedging action, wherein the receiving portion associated with the vertical pole has two lateral flanges delimiting the housing for the end of the horizontal portion of the L-shaped element, the flanges having respective indentations for receiving lateral projections that function as the locating feature and are located proximate the end of the horizontal portion so as to locate the horizontal portion in a proper position within the receiving portion.

2. The facade scaffold of claim 1, wherein at least one elongated reinforcing member includes safety handrails each of which has an opening at the first end in which one of the second quick coupling mechanisms is inserted, the first end of the elongated reinforcing member having a pair of slots that extend from the opening and are inclined to one another, a width of the slot being slightly greater than a width of the pivotable clamping piece to permit the connection and disconnection thereof in angular positions of the safety handrails in which the pivotable clamping piece coincides with one of the slots.

3. The facade scaffold of claim 1, wherein the receiving portion associated with the vertical pole includes a recess formed therein proximate where the receiving portion joins the vertical pole, the recess being configured to receive a projection of the end of the horizontal portion of the L-shaped member for coupling the horizontal portion to the vertical pole by vertical downward movement of the L-shaped member.

4. The facade scaffold of claim 1, wherein the pivotable fastener associated with the horizontal portion of the L-shaped member includes a pair of arms that are articulated, at their upper ends, to the end of the horizontal portion of the L-shaped element, the pivotable fastener further including a bottom edge that is intended to coincide and intimately engage a lower arcuate edge of the receiving portion associated with the vertical pole so as to permit a wedging action between the pivotable fastener and the receiving portion resulting in the L-shaped member being securely coupled to the vertical pole.

5. The facade scaffold of claim 1, wherein the pivotable fastener associated with the horizontal portion of the L-shaped member has, at a bottom thereof; an eccentric mass for promoting the pivoting of the fastener in a direction to cause a wedging action between the pivotable fastener and the receiving portion resulting in the L-shaped member being securely coupled to the vertical pole.

6. The facade scaffold of claim 1, wherein portions of the lateral projections of the horizontal portion of the L-shaped element that are intended to be received in the complementary indentations of the receiving portion are defined by end regions of a through pin that is coupled to the horizontal arm, the ends of the through pin being coupled to a pair of arms that are articulated, at their upper ends, to the end of the horizontal portion of the L-shaped element.

7. The facade scaffold of claim 4, wherein the bottom edge of the pivotable fastener and the lower arcuate edge of the receiving portion have substantially the same shape so as to be complementary to one another.

8. A facade scaffold formed of demountable elements which can be connected to one another to form lateral frames comprising:

a first frame member that is defined by a vertical portion and a horizontal portion that includes a pivotable fastener coupled thereto and pivotable about an axis defined by an elongated first member;

a vertical frame member that includes a support member that projects outwardly from a vertical base portion of the frame member, the support member being shaped to receive and hold one end of the horizontal portion of the first frame member, the horizontal portion including a first locating feature in the form of the first member that mates with a second locating feature that is formed as part of the support member and is in the form of complementary indents that receive ends of the elongated first member so as to locate and fix the horizontal portion relative to the support member while still permitting pivoting of the pivotable fastener, the support surface having an arcuate lower edge that intimately engages a coupling edge that is formed as part of the pivotable fastener so as to permit a wedging action between the pivotable fastener and the support member resulting in the first frame member being securely coupled to the vertical pole, wherein the support member cradles the horizontal portion of the first frame member and the first member extends across the support member.

9. The facade scaffold of claim 8, wherein the pivotable fastener includes a pair of arms that are articulated, at their upper ends, to one end of the horizontal portion of the first frame member, the pivotable fastener being pivotable about the first member that has ends that are received within the complementary indents formed in sides of the support member so as to assist in locating and retaining the horizontal portion in the support member.

10. The facade scaffold of claim 8, wherein the first member comprises a projection extending outwardly from one side of the horizontal portion.

11. The facade scaffold of claim 10, wherein the indents are formed in a bottom surface of the support member between two side flanges thereof, the projection extending downward in the same direction as the pivotable fastener.

12. The facade scaffold of claim 8, wherein the pivotable fastener includes an eccentric mass to facilitate the pivoting of the pivotable fastener in a direction toward the support member to cause the wedging action therebetween.

13. The facade scaffold of claim 12, wherein the coupling edge is formed between the pair of arms and above the eccentric mass so that it is formed between the eccentric mass and the horizontal portion.

14. A facade scaffold formed of demountable elements which can be connected to one another to form lateral frames that include vertical members, the lateral frames comprising:

an inverted L-shaped member that is defined by a vertical portion and a horizontal portion, the horizontal portion having a pivotable fastener that is pivotably connected about a pin to the horizontal portion at one end thereof and a vertical support member having an extension projecting outwardly therefrom, the extension defining a surface that receives an end of the horizontal portion and includes a first coupling feature that receives ends of the pin for locating and restricting movement of the horizontal portion relative to the extension and a second coupling feature in the form of an arcuate edge, formed on an underside of the extension, that is received in and engages a groove formed in an inner surface of the pivotable fastener as the pivotable fastener travels along the arcuate edge resulting in a wedging action between the pivotable fastener and the extension so as to securely assemble the inverted L-shaped member to the vertical support member.

* * * * *